US009085411B1

(12) United States Patent
Ligocki

(10) Patent No.: US 9,085,411 B1
(45) Date of Patent: Jul. 21, 2015

(54) SELF SUPPORTING DECORATIVE COVER FOR BEVERAGE CARRIERS AND DISPENSERS

(76) Inventor: Thomas D. Ligocki, Whitelaw, WI (US)

( * ) Notice: Subject to any disclaimer, the term of this patent is extended or adjusted under 35 U.S.C. 154(b) by 83 days.

(21) Appl. No.: 13/440,741

(22) Filed: Apr. 5, 2012

Related U.S. Application Data

(60) Provisional application No. 61/472,966, filed on Apr. 7, 2011.

(51) Int. Cl.
*B65F 1/14* (2006.01)
*A24F 19/00* (2006.01)

(52) U.S. Cl.
CPC .. *B65F 1/14* (2013.01); *A24F 19/00* (2013.01)

(58) Field of Classification Search
CPC ..... B65F 1/14; B65F 1/08; A24F 19/00; A45C 11/20; A45C 7/0063
USPC ..... 220/694, 903, 738, 739, 416; 206/457, 206/427, 504, 549; 229/117.27, 939, 229/125.22, 125.19
See application file for complete search history.

(56) References Cited

U.S. PATENT DOCUMENTS 3,211,283 A * 10/1965 Hassler ..... 206/424
5,323,922 A * 6/1994 Lapoint et al. ..... 220/4.28
5,967,322 A * 10/1999 Apps et al. ..... 206/497
2003/0111523 A1* 6/2003 Haugan ..... 229/125.19
2012/0074015 A1* 3/2012 Weissbrod ..... 206/443

* cited by examiner

*Primary Examiner* — Fenn Mathew
*Assistant Examiner* — Cynthia Collado
(74) *Attorney, Agent, or Firm* — Maier & Maier, PLLC

(57) ABSTRACT

A cover for a beverage dispensing container is provided that is adapted to be positioned directly over the container. The cover includes a decorative exterior that provides the desired aesthetic appearance to the container. The cover is shaped to conform to the shape of the container such that the cover encloses the container with the exception of the dispenser in order to enable the beverage held in the container to be easily dispensed from the container. The interior of the cover includes a number of support panels that provide sufficient rigidity to the cover to enable the cover to stand over the container.

7 Claims, 7 Drawing Sheets

SELF SUPPORTING DECORATIVE COVER FOR BEVERAGE CARRIERS AND DISPENSERS

CROSS-REFERENCE TO RELATED APPLICATIONS

This application claims priority from U.S. Provisional Patent Application Ser. No. 61/472,966, filed on Apr. 7, 2011, the entirety of which is hereby incorporated herein by reference.

FIELD OF THE INVENTION

The present invention relates to a self supporting decorative cover for beverage carriers and dispensers.

BACKGROUND OF THE INVENTION

Beverages containers of many different types are utilized to dispense beverages of various types to individuals desiring to consume the beverages. The containers can have a variety of shapes and configurations, in addition to a number of different types of dispensing mechanisms. In each configuration, the beverage dispenser is designed to hold a relatively large amount of the particular beverage to be dispensed.

In order to enable the dispensers to function effectively, they are often formed of plastic materials that enhance the ability of the container to retain the beverage in a hot or cold state, based in part on the properties of the materials used to form the containers. Further, the use of plastics enables the containers to be formed in virtually any shape due to the ability of plastic to conform to the shape of a mold for the desired container configuration.

One concern with containers of this type is that, while effective in providing desired amounts of the beverage, the aesthetic appearance of the container is limited based on the manner of its manufacture or construction. As a result, when dispensing beverage containers of these types are utilized, they often detract from, or at the very least, do not enhance the appearance of the environment in which they are placed.

To address this concern, covers have been developed that are placed over the beverage containers that provide an enhancement to the esthetic appearance of the containers. These covers fit over the beverage dispensing containers and are formed of a cloth bag that is shaped to conform exactly to the shape of the beverage dispensing container, such that when placed on the container, these covers assume the shape of the carrier/dispenser. One significant drawback to covers of this type is that if the cover is not formed correctly, or if the material forming the cover has somehow become altered in shape, such as by shrinking, the covers cannot fit the container, with the resultant effect is little or no aesthetic improvement to the appearance of the container. Further, existing covers are made as a single piece so they cannot be adapted to various motifs. Additionally, once the covers become soiled or worn they must be disposed of.

Thus, there exists a need for a device to be utilized in conjunction with beverage dispensing containers that can readily enhance the appearance of the containers in a manner that prevents the containers from detracting from the aesthetic environment in which the containers are used.

SUMMARY OF THE INVENTION

Therefore, according to one aspect of the present invention, a cover for a beverage dispensing container is provided that is adapted to be positioned directly over the container. The cover includes a decorative exterior that provides the desired aesthetic appearance to the container. The cover is shaped to conform to the shape of the container such that the cover encloses the container with the exception of the dispenser in order to enable the beverage held in the container to be easily dispensed from the container. The interior of the cover includes a number of support panels that provide sufficient rigidity to the cover to enable the cover to stand over the container.

According to another aspect of the present invention, cover includes a strap that is releasably positioned on the outside of the cover to provide additional stability to the cover.

According to a further aspect of the present invention, interior support panels of the cover are removable from the decorative exterior. This enables the decorative exterior to be cleaned in a conventional manner when soiled, and for the interior support panels to be used in other decorative exteriors to enclose similarly shaped containers.

Other aspects, advantages and features of the present invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
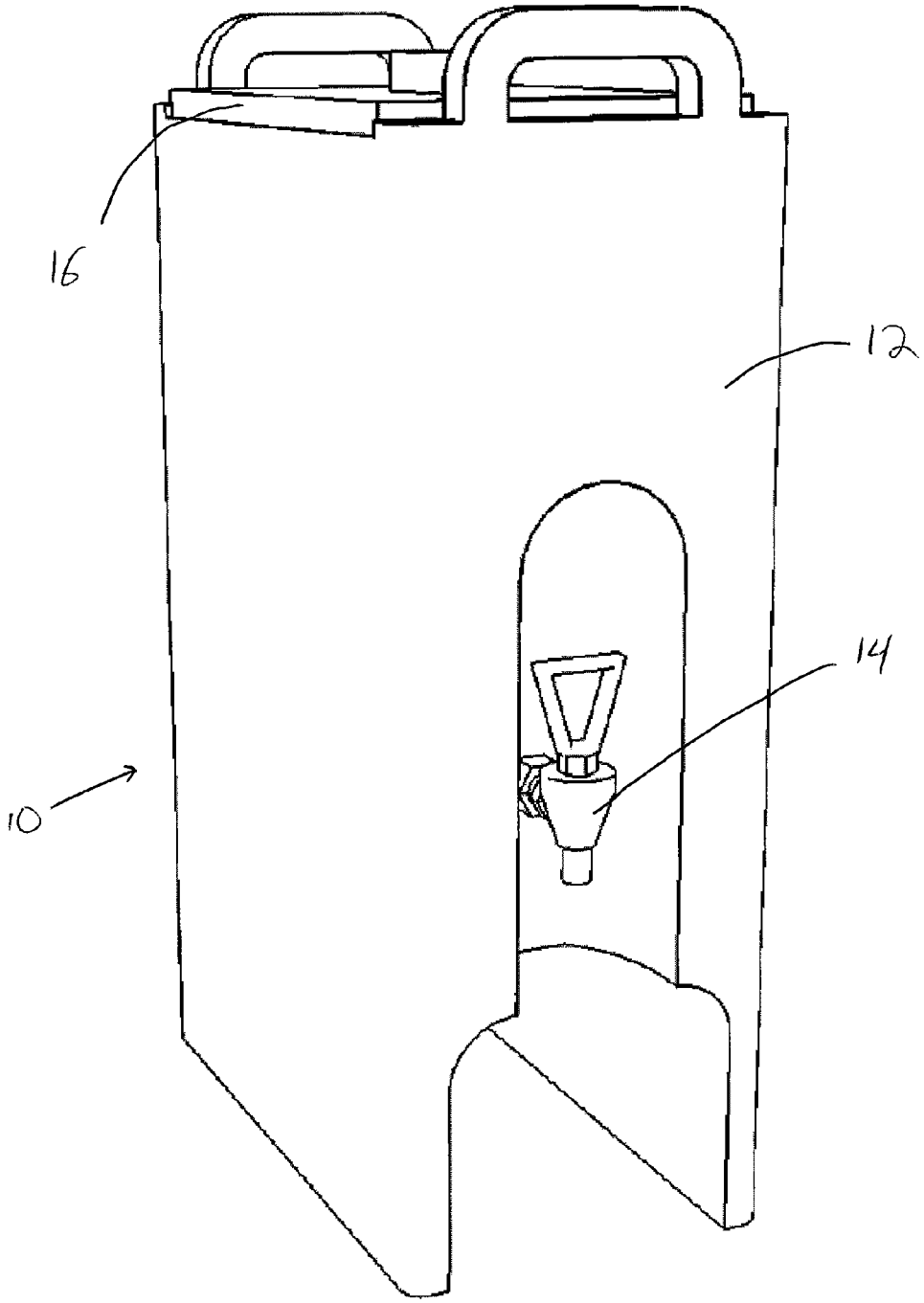
FIG. 1 is an isometric view of a beverage dispenser for use with the cover of the present invention.

With reference now to the drawing figures in which like reference number designate like parts throughout the disclosure, a beverage container is shown generally at 10 in FIG. 1. The container 10 can be formed with any suitable shape and of any suitable material, and includes a generally hollow body 12, a dispenser 14 attached to the body 12 for dispensing the beverage held within the body 12, and a lid 16 for accessing the interior off the container 10 to empty or fill the interior with additional amounts of the beverage.

Referring now to FIGS. 2-6, a cover 18 constructed according to one embodiment of the present invention is positioned over the container 10. In the illustrated embodiment, the cover 18 includes a decorative exterior member 20 and a number of interior support panels 22.

Figure 3:
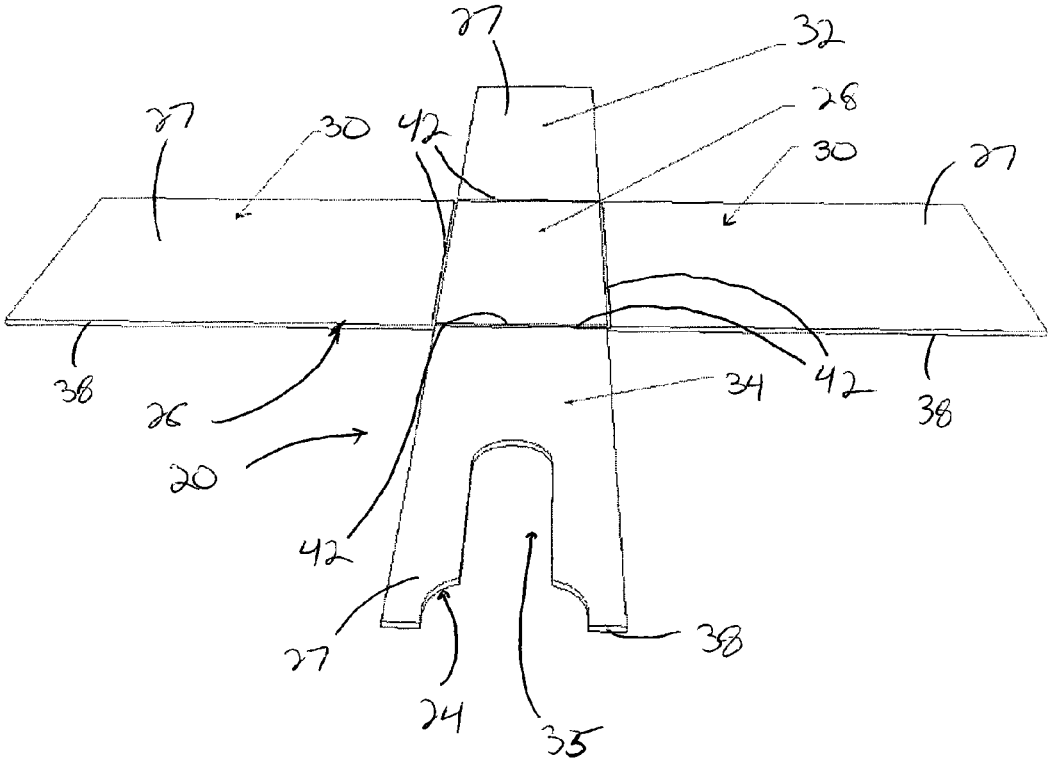
FIG. 3 is an isometric view of the exterior component of the cover of FIG. 2.
Figure 6:
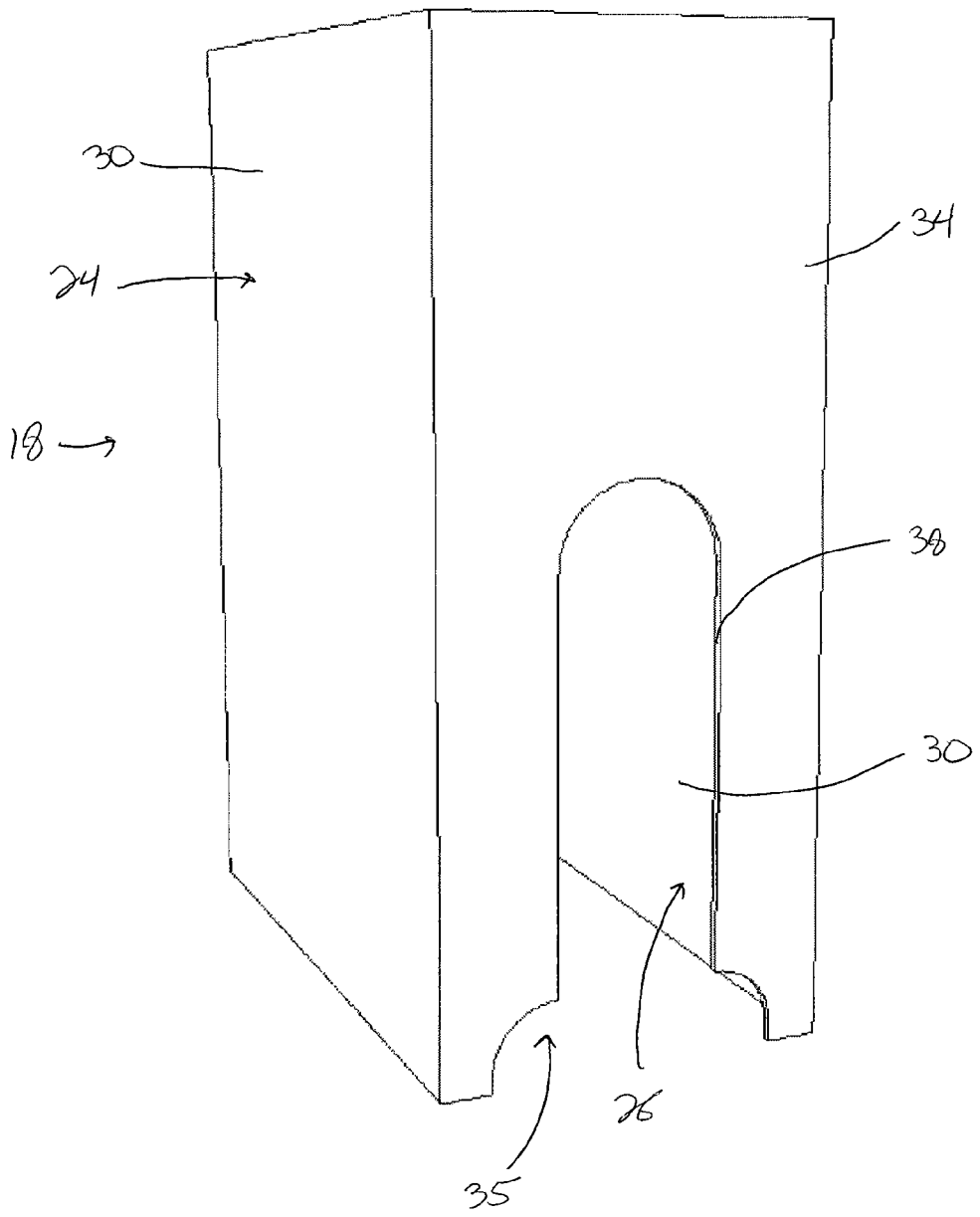
FIG. 6 is an isometric view of the cover of FIG. 2.

The decorative exterior member 20, as best shown in FIGS. 3 and 6, is formed of any suitable material, such as a fabric, natural or synthetic cloth material, leather, plastic, rubber, etc, with any desired pattern or texture, and includes an exterior surface member 24 on which a desired pattern is formed. The exterior member 20 also includes an interior surface member 26 that can also be formed of any desired material, which can be the same or different than the material forming the exterior surface 24. The exterior surface 24 and the interior surface 26 are shaped to be able to form an enclosure over the container 10 when formed into the cover 18. In the illustrated embodiment, the exterior surface 24 is formed of a unitary piece of the selected material, while the interior surface 26 is formed of separate pieces 27 of the selected material that are attached to the exterior surface 24.

In the illustrated embodiment, the decorative exterior member 20 is shaped to include a top panel 28, a pair of opposed side panels 30, a rear panel 32 and a front panel 34, which defines an aperture 35 for the dispenser 14 of the container 10. The respective panels 28-34 are formed by attaching the exterior surface 24 and interior surface 26 to one another along their aligned edges. The surfaces 24 and 26 can be attached or secured to one another in any suitable manner, such as by stitching, adhesives, or mechanical fasteners, among others. For each of the side panels 30, the rear panel 32 and the front panel 34, the edges 36 adjacent the top panel 28 are left unattached, such that the side panels 30, the rear panel 32 and the front panel 34 form openings 42 for pockets 38 located between the surfaces 24 and 26 when the surfaces 24 and 26 are secured to one another. For the top panel 28, one edge 40 adjacent the rear panel 30 or front panel 32 is left unattached to form an opening 42 into a pocket 38 located within the top panel 28 between the surfaces 24 and 26. The pockets 38 extend over the entire area of the respective panels 28-34.

Figure 4:
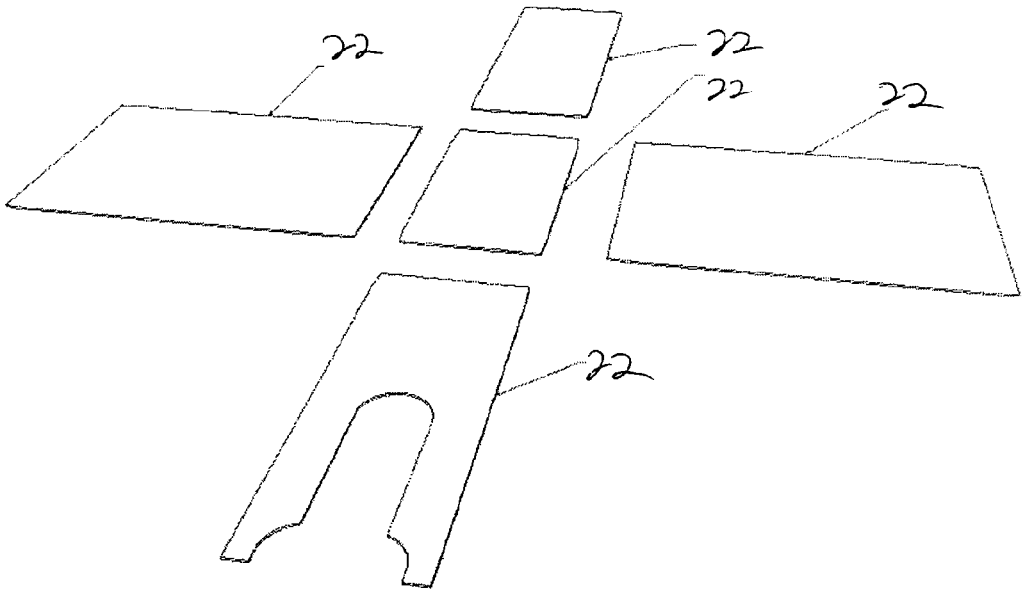
FIG. 4 is an isometric view of the interior components of the cover of FIG. 2.
Figure 5:
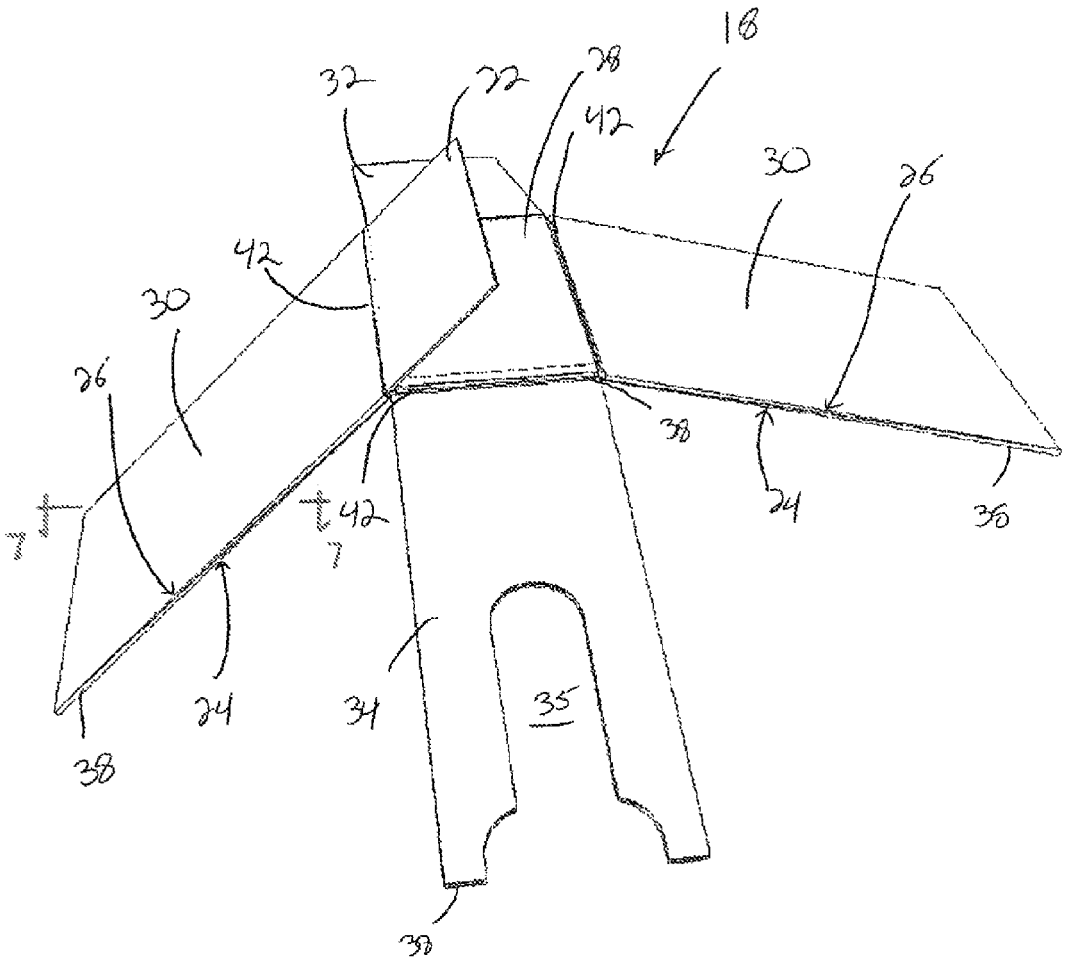
FIG. 5 is an isometric view illustrating the assembly of the interior and exterior components of the cover of FIG. 2.

Looking now at FIGS. 4-5, the interior support panels 22 are formed of any suitable rigid material, such as a metal or plastic, among others, and are sized to conform to the size and shape of the pockets 38 formed in the respective panels 28-34. The support panels 22 can additionally be formed to include different contours or design features thereon, in order to enhance the ability of the cover 18 to conform to and/or provide the desired shape for the cover 18 over the container 10, which may be different than the shape of the container 10, such as a shape simulating another object.

Figure 7:
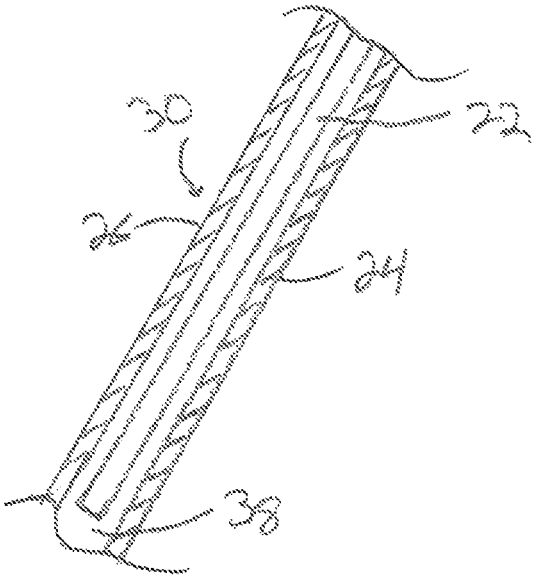
FIG. 7 is a cross-sectional view along line 7-7 of FIG. 5.

To assemble the cover 18, the interior support panels 22 are inserted into the correspondingly-shaped pockets 38 as shown in FIGS. 5 and 7. In the illustrated embodiment, the openings 42 for the pockets 38 are located on the interior of the cover 18, so as not to detract from the aesthetic appearance of the cover 18. Once each of the support panels 22 is located in the associated pocket 38 formed in the panels 28-34, the panels 28-34 can be folded with respect to one another to position the cover 18 in the configuration shown in FIG. 6. In this position, the openings 42 for the pockets 38 are located on the interior of the cover 18, with only the seamless exterior surface 24 of the decorative exterior member 20 being visible. Further, the size of the panels 22 is located in the pockets 38 is such that when the cover 18 is in the position of FIG. 6, the panels 22 do not leave significant size gaps therebetween.

Figure 2:
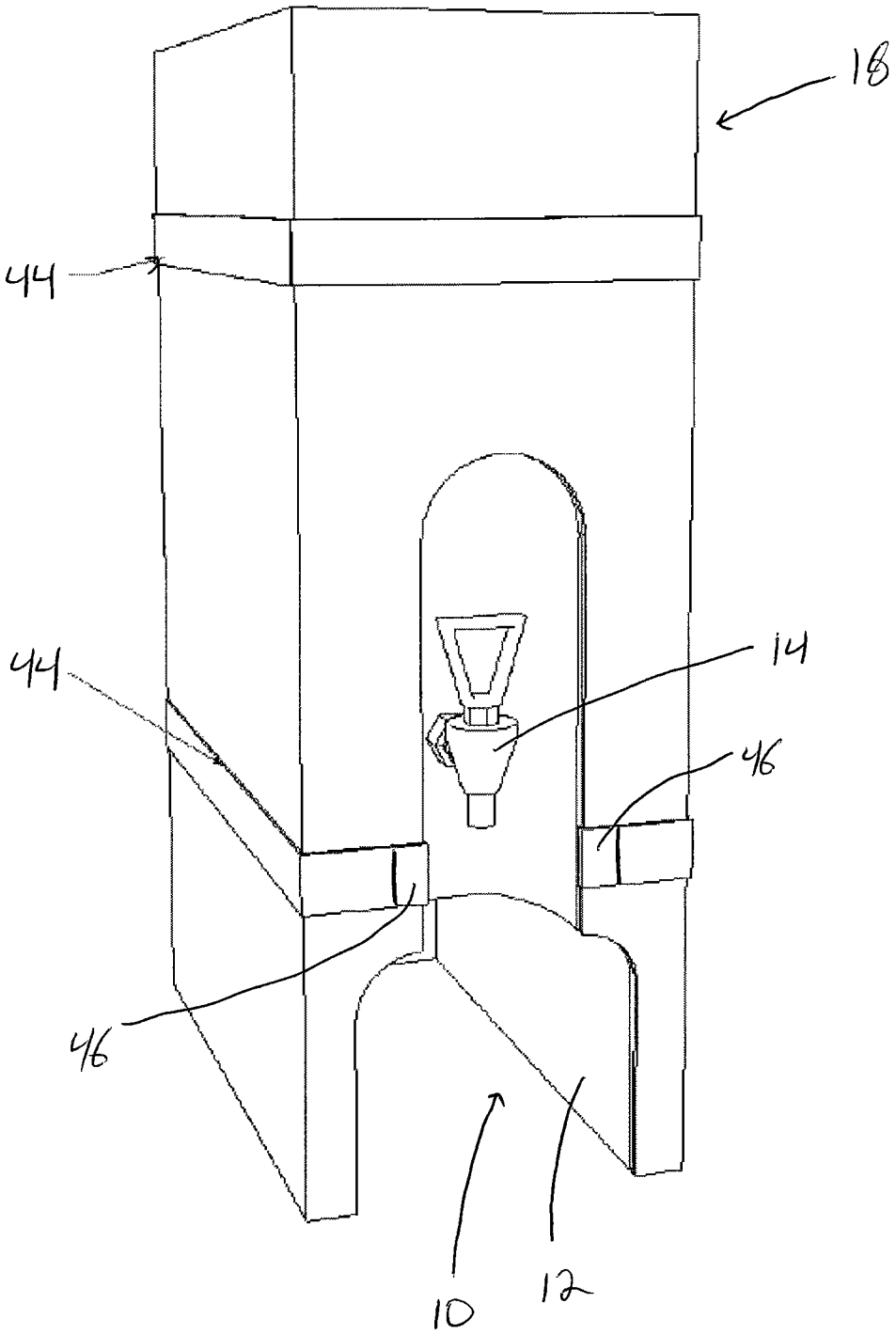
FIG. 2 is an isometric view of a first embodiment of the cover of the present invention disposed over the beverage dispenser of FIG. 1.

Once the cover 18 is positioned as shown in FIG. 6, a number of belts 44 can be located around the exterior of the cover 18, as shown in FIG. 2. The belts 44 are formed of any suitable material and operate to maintain the cover 18 in the position of FIG. 6. The belts 44 can be formed of an elastic material, which enables the belts 44 to be positioned around the cover 18 without the need for any additional fastening devices. Alternatively, the belts 44 can be formed, optionally of an elastic material, with suitable fastening devices 46, such as a hook and loop fastener, or other suitable device, on each end that enable the belt 44 to be secured to complementary fastening devices (not shown) located on the exterior surface 24 or the interior surface 26 of the exterior decorative member 20, or directly to the exterior decorative member 20.

When the belts 44 are secured around the exterior decorative member 20, the cover 18 can be moved and placed directly over the container 10 with the aperture 35 in the front panel 34 aligned with the dispenser 14 of the container 10.

To disassemble the cover 18 after use, the belts 44 are removed from the exterior decorative member 20, and the support panels 22 are removed from the pockets in each panel 28-34 of the exterior member 20. The exterior member 20 can then be stored with the belts 44 and panels 22, or cleaned, such as by machine washing the exterior member 20.

Additionally, the support panels 22 and belts 44 can be switched between exterior covers 20 shaped for similar container 10 in order to vary the appearance of the cover 18 when desired. Further, different support panels 22 can be used with the same exterior member 20 in order to provide a modified shape to the cover 18.

While the concepts of the present disclosure will be illustrated and described in detail in the drawings and description, such an illustration and description is to be considered as exemplary and not restrictive in character, it being understood that only the illustrative embodiments are shown and described and that all changes and modifications that come within the spirit of the disclosure are desired to be protected. There are a plurality of advantages that may be inferred from the present disclosure arising from the various features of the apparatus, systems, and methods described herein. It will be noted that alternative embodiments of each of the apparatus, systems, and methods of the present disclosure may not include all of the features described yet still benefit from at least some of the inferred advantages of such features. Those of ordinary skill in the art may readily devise their own implementations of an apparatus, system, and method that incorporate one or more of the features of the present disclosure and fall within the spirit and scope of the disclosure as defined by the appended claims.

I claim:

1. A cover for a beverage dispensing container comprising:

a) an exterior decorative member including a number of panels each having a unitary exterior surface member and an interior surface member operatively connected to the exterior surface member, and a pocket formed between the exterior surface member and the interior surface member, wherein the interior surface member comprises a number of separate pieces of a material connected to the exterior surface member wherein the pockets extend over the entire area of the panels, wherein each pocket has an opening; wherein the number of panels comprise:

a top panel;

a pair of opposed side panels joined to the top panel;

a rear panel joined to the top panel between the side panels; and a front panel joined to the top panel opposite the rear panel b) a number of support panels corresponding in shape to the panels and positioned within the pockets in the exterior decorative member, wherein the cover defines an interior adapted to receive the beverage dispensing container and wherein the support panels are removably inserted into the openings of pockets wherein the openings are disposed within the interior of the cover proximate the top panel.

2. The cover of claim 1 further comprising a belt disposed around the exterior decorative member.

3. The cover of claim 2 wherein the belt is formed of an elastic material.

4. The cover of claim 3 wherein the belt includes a fastening device.

5. The cover of claim 4 wherein the belt is operably secured to the exterior decorative member.

6. The cover of claim 1 wherein the front panel includes an aperture positionable in alignment with a dispenser for the beverage dispensing container to be located within the cover.

7. The cover of claim 1 wherein the exterior decorative member is made of machine washable materials.

* * * * *